US010577945B2

(12) United States Patent
Brittingham et al.

(10) Patent No.: US 10,577,945 B2
(45) Date of Patent: Mar. 3, 2020

(54) TURBOMACHINE ROTOR BLADE

(71) Applicant: General Electric Company, Schenectady, NY (US)

(72) Inventors: Robert Alan Brittingham, Greer, SC (US); Mark Andrew Jones, Ponte Vedra Beach, FL (US)

(73) Assignee: General Electric Company, Schenectady, NY (US)

( * ) Notice: Subject to any disclaimer, the term of this patent is extended or adjusted under 35 U.S.C. 154(b) by 356 days.

(21) Appl. No.: 15/638,603

(22) Filed: Jun. 30, 2017

(65) Prior Publication Data

US 2019/0003318 A1 Jan. 3, 2019

(51) Int. Cl.

| | |
|---|---|
| ***F01D 5/18*** | (2006.01) |
| ***F01D 5/14*** | (2006.01) |
| ***F01D 5/20*** | (2006.01) |
| ***F01D 5/22*** | (2006.01) |

(52) U.S. Cl.

CPC ..... *F01D 5/187* (2013.01); *F01D 5/147* (2013.01); *F01D 5/20* (2013.01); *F01D 5/225* (2013.01); *F01D 5/18* (2013.01); *F05D 2240/24* (2013.01); *F05D 2240/301* (2013.01); *F05D 2240/307* (2013.01); *F05D 2240/81* (2013.01); *F05D 2260/202* (2013.01)

(58) Field of Classification Search

CPC . F01D 5/147; F01D 5/18; F01D 5/187; F01D 5/20; F01D 5/225

See application file for complete search history.

(56) References Cited

U.S. PATENT DOCUMENTS

| | | | | |
|---|---|---|---|---|
| 3,876,330 | A | 4/1975 | Pearson et al. | |
| 4,127,358 | A | 11/1978 | Parkes | |
| 4,948,338 | A | 8/1990 | Wickerson | |
| 5,460,486 | A * | 10/1995 | Evans | F01D 5/187 415/115 |

(Continued)

FOREIGN PATENT DOCUMENTS

| | | |
|---|---|---|
| EP | 2607629 A1 | 6/2013 |
| FR | 2275975 A5 | 1/1976 |

(Continued)

OTHER PUBLICATIONS

U.S. Appl. No. 14/974,155, filed Dec. 18, 2015.
U.S. Appl. No. 14/974,193, filed Dec. 18, 2015.
U.S. Appl. No. 15/615,876, filed Jun. 7, 2017.

*Primary Examiner* — Sizo B Vilakazi
*Assistant Examiner* — Anthony L Bacon
(74) *Attorney, Agent, or Firm* — Dority & Manning, P.A.

(57) ABSTRACT

The present disclosure is directed to a rotor blade for a turbomachine. The rotor blade includes an airfoil having a trailing edge surface and defining a cooling passage. The rotor blade also includes a tip shroud coupled to the airfoil. The tip shroud includes a radially inner surface. The tip shroud defines a cooling core fluidly coupled to the cooling passage. The cooling core includes at least one of a first outlet aperture having a first opening defined by the radially inner surface or a second outlet aperture having a second opening defined by the trailing edge surface of the airfoil. The first or second outlet apertures eject coolant from the cooling core in a direction of a local flow of combustion gases external to the tip shroud.

20 Claims, 6 Drawing Sheets

(56) References Cited

U.S. PATENT DOCUMENTS

| | | | | |
|---|---|---|---|---|
| 6,099,253 | A | 8/2000 | Fukue et al. | |
| 6,152,694 | A | 11/2000 | Ai | |
| 6,152,695 | A | 11/2000 | Fukue et al. | |
| 6,471,480 | B1 * | 10/2002 | Balkcum, III | F01D 5/186 415/115 |
| 6,811,378 | B2 | 11/2004 | Kraft | |
| 7,273,347 | B2 | 9/2007 | Rathmann | |
| 7,686,581 | B2 | 3/2010 | Brittingham et al. | |
| 7,946,816 | B2 | 5/2011 | Brittingham | |
| 8,096,767 | B1 * | 1/2012 | Liang | F01D 5/187 415/115 |
| 9,127,560 | B2 | 9/2015 | Collier et al. | |
| 2006/0056969 | A1 * | 3/2006 | Jacala | F01D 5/186 416/97 R |
| 2009/0180896 | A1 * | 7/2009 | Brittingham | F01D 5/225 416/97 R |
| 2009/0304520 | A1 * | 12/2009 | Brittingham | F01D 5/187 416/97 R |
| 2012/0070309 | A1 | 3/2012 | Zambetti et al. | |
| 2015/0345306 | A1 * | 12/2015 | Chouhan | F01D 5/225 416/183 |
| 2016/0076385 | A1 * | 3/2016 | Chouhan | F01D 5/143 416/191 |
| 2017/0114645 | A1 | 4/2017 | Chouhan et al. | |
| 2017/0114647 | A1 | 4/2017 | Chouhan et al. | |
| 2017/0114648 | A1 | 4/2017 | Chouhan et al. | |
| 2017/0130588 | A1 * | 5/2017 | Townes | F01D 5/187 |
| 2017/0138203 | A1 | 5/2017 | Jaiswal et al. | |

FOREIGN PATENT DOCUMENTS

| | | | | |
|---|---|---|---|---|
| JP | 2012225211 A | * | 11/2012 | F01D 5/187 |
| JP | 5868609 B2 | | 2/2016 | |

* cited by examiner

TURBOMACHINE ROTOR BLADE

FIELD

The present disclosure generally relates to turbomachines. More particularly, the present disclosure relates to rotor blades for turbomachines.

BACKGROUND

A gas turbine engine generally includes a compressor section, a combustion section, and a turbine section. The compressor section progressively increases the pressure of air entering the gas turbine engine and supplies this compressed air to the combustion section. The compressed air and a fuel (e.g., natural gas) mix within the combustion section and burn within one or more combustion chambers to generate high pressure and high temperature combustion gases. The combustion gases flow from the combustion section into the turbine section where they expand to produce work. For example, expansion of the combustion gases in the turbine section may rotate a rotor shaft connected to a generator to produce electricity.

The turbine section generally includes a plurality of rotor blades. Each rotor blade includes an airfoil positioned within the flow of the combustion gases. In this respect, the rotor blades extract kinetic energy and/or thermal energy from the combustion gases flowing through the turbine section. Certain rotor blades may include a tip shroud coupled to the radially outer end of the airfoil. The tip shroud reduces the amount of combustion gases leaking past the rotor blade.

The rotor blades generally operate in extremely high temperature environments. As such, the airfoils and tip shrouds of rotor blades may define various passages, cavities, and apertures through which coolant may flow. After flowing through the various passages, cavities, and apertures, the coolant is exhausted from the tip shroud into the flow of combustion gases. Nevertheless, conventional configurations of these passages, cavities, and apertures may result in disturbance of the flow of combustion gases, thereby resulting in reduced aerodynamic performance.

BRIEF DESCRIPTION

Aspects and advantages of the technology will be set forth in part in the following description, or may be obvious from the description, or may be learned through practice of the technology.

In one aspect, the present disclosure is directed to a rotor blade for a turbomachine. The rotor blade includes an airfoil having a trailing edge surface and defining a cooling passage. The rotor blade also includes a tip shroud coupled to the airfoil. The tip shroud includes a radially inner surface. The tip shroud defines a cooling core fluidly coupled to the cooling passage. The cooling core includes at least one of a first outlet aperture having a first opening defined by the radially inner surface and a second outlet aperture having a second opening defined by the trailing edge surface of the airfoil. The first or second outlet apertures are configured to eject coolant from the cooling core in a direction of a local flow of combustion gases external to the tip shroud.

In another aspect, the present disclosure is directed to a turbomachine including a turbine section having one or more rotor blades. Each rotor blade includes an airfoil having a trailing edge surface and defining a cooling passage. Each rotor blade also includes a tip shroud coupled to the airfoil. The tip shroud includes a radially inner surface.

The tip shroud defines a cooling core fluidly coupled to the cooling passage. The cooling core includes at least one of a first outlet aperture having a first opening defined by the radially inner surface and a second outlet aperture having a second opening defined by the trailing edge surface of the airfoil. The first or second outlet apertures are configured to eject coolant from the cooling core in a direction of a local flow of combustion gases external to the tip shroud.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode of practicing the various embodiments, is set forth in the specification, which makes reference to the appended figures, in which.

Figure 1:
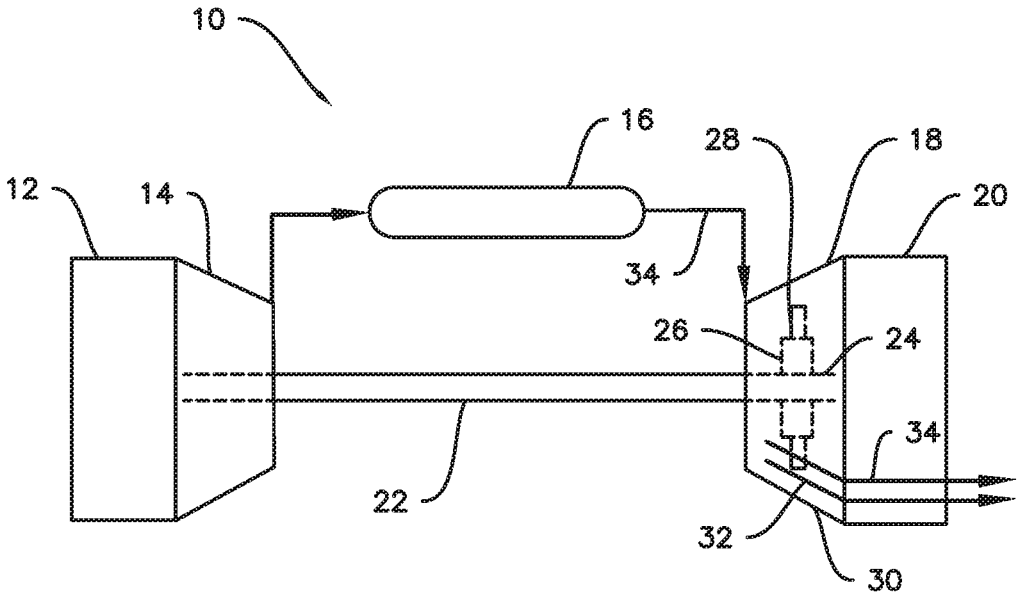
FIG. 1 is a schematic view of an exemplary gas turbine engine in accordance with the embodiments disclosed herein.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. As shown, the gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may include a rotor shaft 24 having a plurality of rotor disks 26 (one of which is shown) and a plurality of rotor blades 28. Each rotor blade 28 extends radially outward from and interconnects to one of the rotor disks 26. Each rotor disk 26, in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, the gas turbine engine 10 produces mechanical rotational energy, which may, e.g., be used to generate electricity. More specifically, air enters the inlet section 12 of the gas turbine engine 10. From the inlet section 12, the air flows into the compressor 14, where it is progressively compressed to provide compressed air to the combustion section 16. The compressed air in the combustion section 16 mixes with a fuel to form an air-fuel mixture, which combusts to produce high temperature and high pressure combustion gases 34. The combustion gases 34 then flow through the turbine 18, which extracts kinetic and/or thermal energy from the combustion gases 34. This energy extraction rotates the rotor shaft 24, thereby creating mechanical rotational energy for powering the compressor section 14 and/or generating electricity. The combustion gases 34 exit the gas turbine engine 10 through the exhaust section 20.

Figure 2:
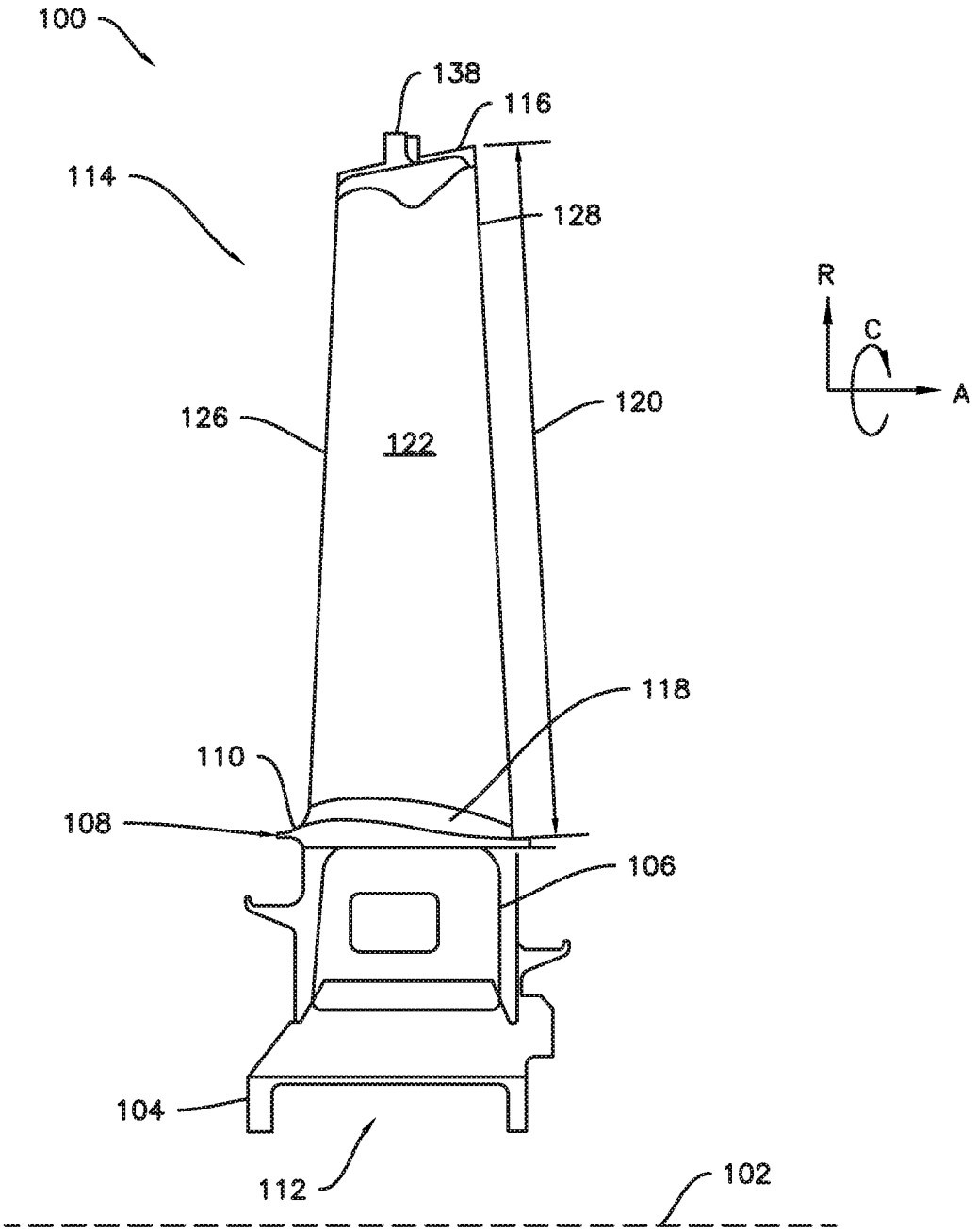
FIG. 2 is a side view of an exemplary rotor blade in accordance with the embodiments disclosed herein.

FIG. 2 is a side view of an exemplary rotor blade 100, which may be incorporated into the turbine section 18 of the gas turbine engine 10 in place of the rotor blade 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102. The rotor blade 100 may also be incorporated into the compressor section 14 of the gas turbine engine 10 (FIG. 1).

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, the shank portion 106, and the platform 108 may define an intake port 112, which permits a coolant (e.g., bleed air from the compressor section 14) to enter the rotor blade 100. In the embodiment shown in FIG. 2, the dovetail 104 is an axial entry fir tree-type dovetail. Alternately, the dovetail 104 may be any suitable type of dovetail. In fact, the dovetail 104, shank portion 106, and/or platform 108 may have any suitable configurations.

Figure 3:
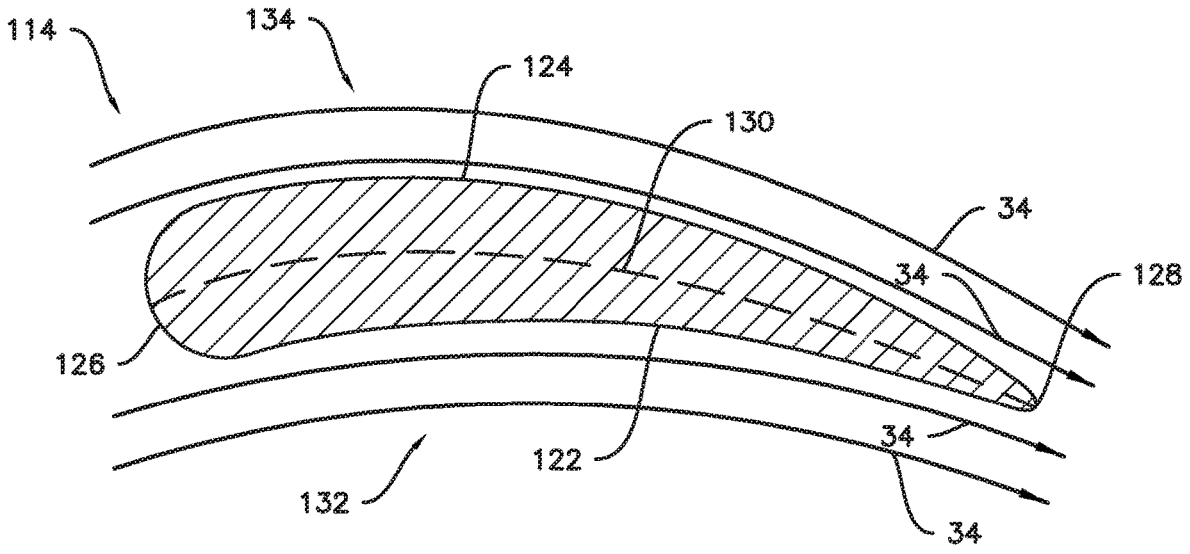
FIG. 3 is cross-sectional view of an exemplary airfoil in accordance with the embodiments disclosed herein.
Figure 4:
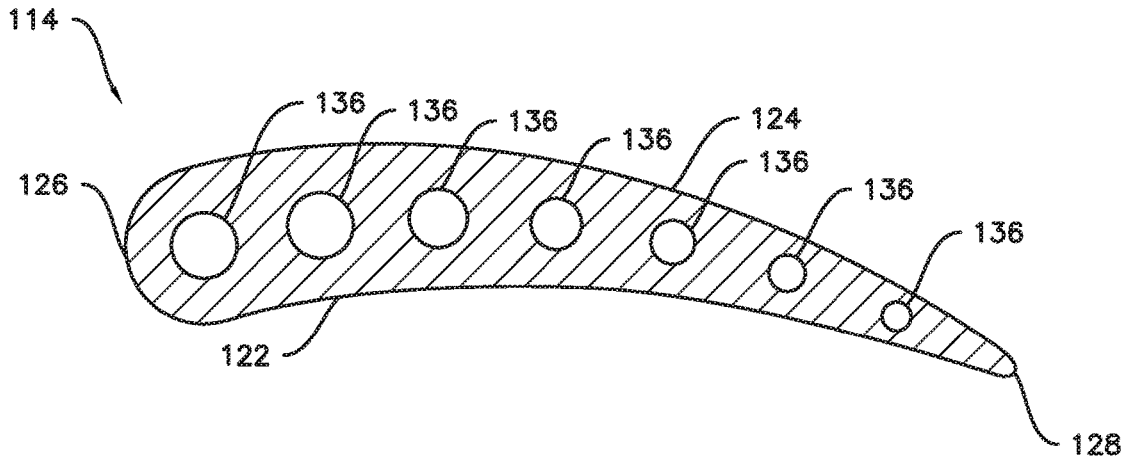
FIG. 4 is a cross-sectional view of another exemplary airfoil in accordance with embodiments of the present disclosure.

Referring now to FIGS. 2-4, the rotor blade 100 further includes an airfoil 114. In particular, the airfoil 114 extends radially outward from the radially outer surface 110 of the platform 108 to a tip shroud 116. The airfoil 114 couples to the platform 108 at a root 118 (i.e., the intersection between the airfoil 114 and the platform 116). In this respect, the airfoil 118 defines an airfoil span 120 extending between the root 118 and the tip shroud 116. The airfoil 114 also includes a pressure side surface 122 and an opposing suction side surface 124 (FIG. 3). The pressure side surface 122 and the suction side surface 124 are joined together or interconnected at a leading edge surface 126 of the airfoil 114 and a trailing edge surface 128 of the airfoil 114. As shown, the leading edge surface 126 is oriented into the flow of combustion gases 34 (FIG. 1), while the trailing edge surface 128 is spaced apart from and positioned downstream of the leading edge surface 126. Furthermore, the pressure side surface 122 is generally concave, and the suction side surface 124 is generally convex.

As shown in FIG. 3, the airfoil 114 defines a camber line 130. More specifically, the camber line 130 extends from the leading edge surface 126 to the trailing edge surface 128. The camber line 130 is also positioned between and equidistant from the pressure side surface 122 and the suction side surface 124. As shown, the airfoil 114 and, more generally, the rotor blade 100 include a pressure side 132 positioned on one side of the camber line 130 and a suction side 134 positioned on the other side of the camber line 130.

Referring now to FIG. 4, the airfoil 114 may define one or more radially-extending cooling passages 136 extending therethrough. More specifically, the radially-extending cooling passages 136 may extend from the intake port 112 through the airfoil 114 to the tip shroud 116. In this respect, coolant may flow through the radially-extending cooling passages 136 from the intake port 112 to the tip shroud 116. In the embodiment shown in FIG. 4, for example, the airfoil 114 defines seven radially-extending cooling passages 136. In alternate embodiments, however, the airfoil 114 may define more or fewer radially-extending cooling passages 136.

Figure 5:
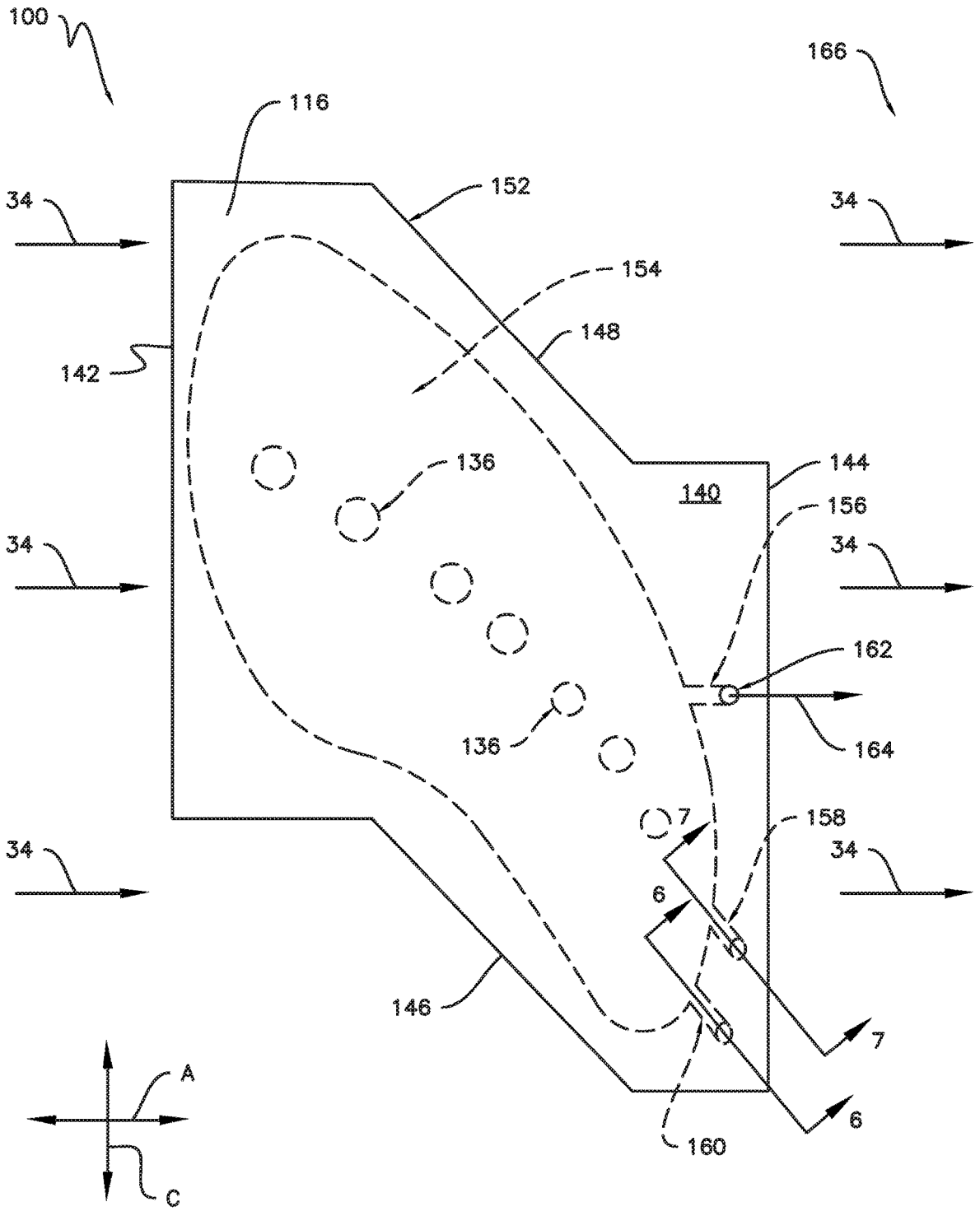
FIG. 5 is a top view of one embodiment of a tip shroud in accordance with embodiments of the present disclosure.

As mentioned above, the rotor blade 100 includes the tip shroud 116. As illustrated in FIGS. 2 and 5, the tip shroud 116 couples to the radially outer end of the airfoil 114 and generally defines the radially outermost portion of the rotor blade 100. In this respect, the tip shroud 116 reduces the amount of the combustion gases 34 (FIG. 1) that escape past the rotor blade 100. As shown, the tip shroud 116 may include a seal rail 138. Alternate embodiments, however, may include more seal rails 138 (e.g., two seal rails 138, three seal rails 138, etc.) or no seal rails 138.

Referring particularly to FIG. 5, the tip shroud 116 includes various exterior surfaces. More specifically, in the embodiment shown, the tip shroud 116 includes a radially outer surface 140. Although omitted from FIG. 5 for clarity, the seal rail(s) 138 may extend radially outward from the radially outer surface 140. The tip shroud 116 may also include a forward surface 142 and an aft surface 144 axially spaced apart from and positioned downstream of the forward surface 142. The tip shroud 116 may further include a pressure side surface 146 positioned on the pressure side 132 of the tip shroud 116 and a suction side surface 148 positioned on the suction side 134 of the tip shroud 116. The pressure side and suction side surfaces 146, 148 generally extend axially from the forward surface 142 to the aft surface 144. Furthermore, the tip shroud 116 may include a radially inner surface 150 (FIGS. 6 and 7), which is radially spaced apart from and positioned radially inward from the radially outer surface 140. The surfaces 140, 142, 144, 146, 148, 150 may be collectively referred to an exterior surface 152. In general, the exterior surface 152 is in contact with the combustion gases 34. In alternate embodiments, however, the tip shroud 116 may have any suitable configuration of exterior surfaces.

The tip shroud 116 defines a cooling core 154 therein to facilitate cooling of the tip shroud 116. More specifically, the cooling core 154 is in fluid communication with one or more of the cooling passages 136. As such, the cooling core 154 may receive coolant from the cooling passages 136. In the embodiment shown in FIG. 5, the cooling core 154 is a single continuous cavity. Alternatively, the cooling core 154 may have any suitable configuration in alternate embodiments.

Figure 6:
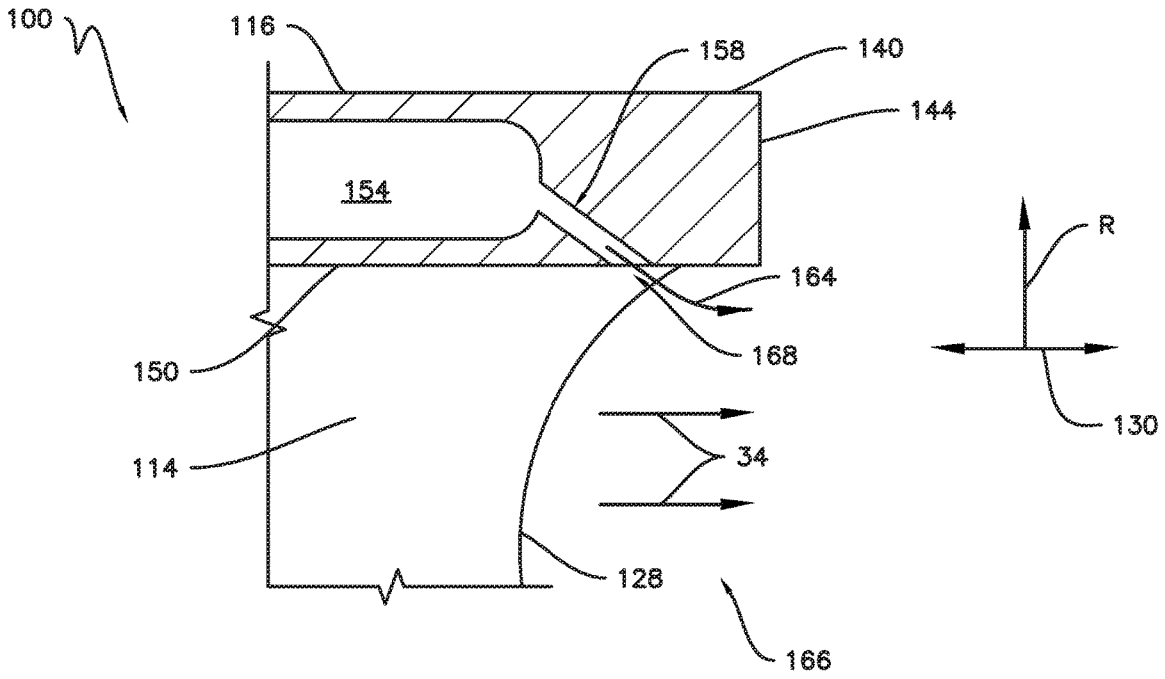
FIG. 6 is a cross-sectional view of the tip shroud taken generally about line 6-6 in FIG. 5, illustrating an outlet aperture defined by the tip shroud in accordance with the embodiments disclosed herein.
Figure 7:
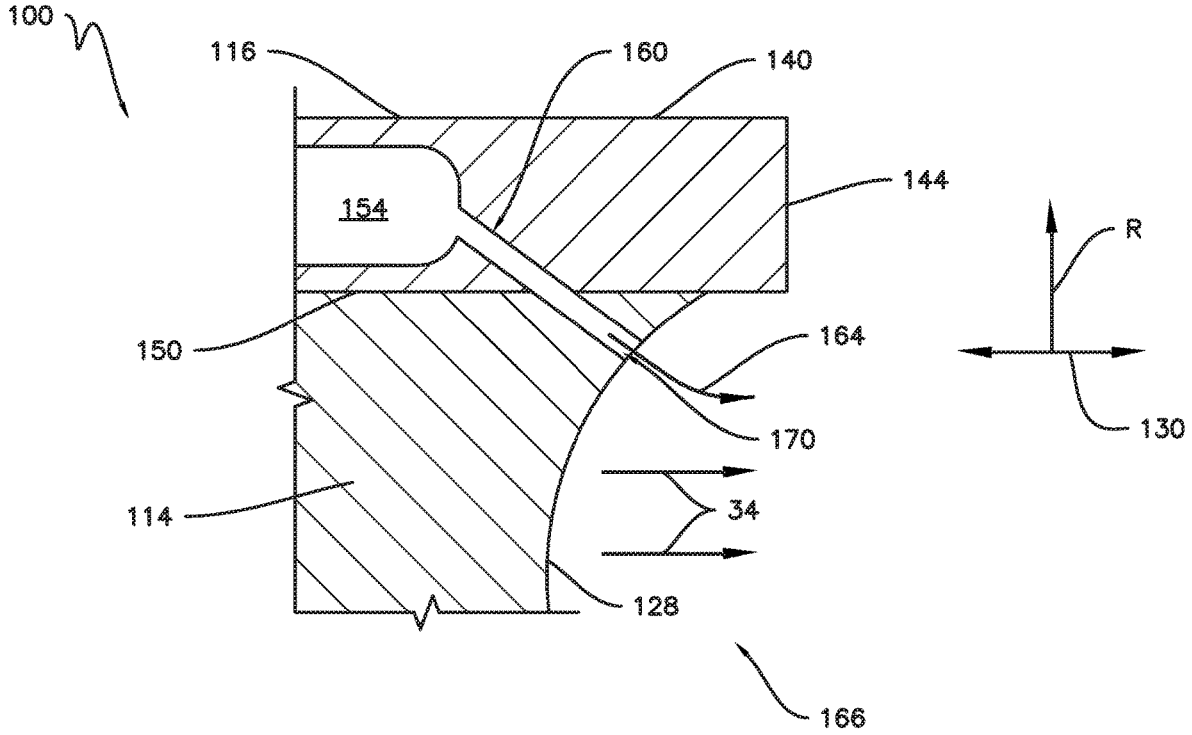
FIG. 7 is a cross-sectional view of the tip shroud taken generally about line 7-7 in FIG. 5, illustrating an outlet aperture defined by the tip shroud and airfoil in accordance with the embodiments disclosed herein.

The tip shroud 116 and the airfoil 114 define various outlet apertures through which coolant is ejected or otherwise exhausted from the cooling core 154. As shown in FIGS. 5-7, for example, the tip shroud 116 and/or the airfoil 114 define first and second outlet apertures 158, 160. In certain embodiments, the tip shroud 116 and/or the airfoil 114 may define only one of the first and second outlet apertures 158, 160. Furthermore, in alternate embodiments, the tip shroud 116 and/or the airfoil 114 may define additional outlet apertures for exhausting coolant from the cooling core 154.

Referring now particularly to FIG. 6, the tip shroud 116 defines the first outlet aperture 158. More specifically, the first outlet aperture 158 is in fluid communication with the cooling core 154 to receive coolant (e.g., as indicated by arrow 164) therefrom. The first outlet aperture 158 includes a first opening 168 defined by the radially inner surface 150 of the tip shroud 116. As such, the coolant 164 flows from the cooling core 154 into the first outlet aperture 158 and is ejected from the first outlet aperture 158 through the first opening 168. Furthermore, the first outlet aperture 158 is oriented or otherwise configured to eject the coolant 164 in a direction of the local flow 166 of the combustion gases 34 external to the radially inner surface 150 of the tip shroud 116. As shown, the direction of the local flow 166 of the combustion gases 34 external to the radially inner surface 150 may be parallel to or substantially parallel to the camber line 130 at the radially inner surface 150. In this respect, the first outlet aperture 158 may be oriented to eject the coolant 164 parallel to or substantially parallel to the camber line 130 at the radially inner surface 150.

As illustrated in FIG. 7, the tip shroud 116 and the airfoil 114 defines the second outlet aperture 160. More specifically, the second outlet aperture 160 is in fluid communication with the cooling core 154 to receive the coolant 164 therefrom. The second outlet aperture 160 includes a second opening 170 defined by the trailing edge surface 128 of the airfoil 114. As such, coolant 164 flows from the cooling core 154 into the second outlet aperture 160 and is ejected from the second outlet aperture 160 through the second opening 170. Furthermore, the second outlet aperture 160 is oriented or otherwise configured to eject the coolant 164 in a direction of the local flow 166 of the combustion gases 34 external to the trailing edge surface 128 of the airfoil 114. As shown, the direction of the local flow 166 of the combustion gases 34 external to the trailing edge surface 128 may be parallel to or substantially parallel to the camber line 130 at the trailing edge surface 128. In this respect, the second outlet aperture 160 may be oriented to eject the coolant 164 parallel to or substantially parallel to the camber line 130 at the trailing edge surface 128.

Referring again to FIG. 5, the tip shroud 116 may also defines a third outlet aperture 156. More specifically, the third outlet aperture 156 is in fluid communication with the cooling core 154 to receive coolant therefrom. The third outlet aperture 156 includes a third opening 162 defined by the radially outer surface 140 of the tip shroud 116. As such, the coolant 164 flows from the cooling core 154 into the third outlet aperture 156 and is ejected from the third outlet aperture 156 through the third opening 162. Furthermore, the third outlet aperture 156 is oriented or otherwise configured to eject the coolant 164 in a direction of a local flow 166 of the combustion gases 34 external to the radially outer surface 140 of the tip shroud 116. As shown, the direction of the local flow 166 of the combustion gases 34 external to the radially outer surface 140 may be in the axial direction A of or substantially in the axial direction A. In this respect, the third outlet aperture 156 may be oriented to eject the coolant 164 parallel to or substantially parallel to the axial direction A. In the embodiment shown in FIG. 5, all coolant flowing through the cooling core 154 is ejected from the first, second, and third outlet apertures 158, 160, 156.

During operation of the gas turbine engine 10, the coolant 164 flows through the cooling core 154 to cool the tip shroud 116. More specifically, the coolant 164 (e.g., bleed air from the compressor section 14) enters the rotor blade 100 through the intake port 112 (FIG. 2). At least a portion of the coolant 164 flows through the cooling passages 136 in the airfoil 114 and into the cooling core 154 of the tip shroud 116. The coolant 164 then flows through the various portions of the cooling core 154, thereby convectively cooling the walls of the tip shroud 116. After flowing through the cooling core 154, the coolant 164 is ejected from the first, second, and third outlet apertures 158, 160, 156 into the hot gas path 32 (FIG. 1).

As mentioned above, the first, second, and third outlet apertures 158, 160, 156 are configured to eject the coolant 164 in the direction of the local flow 166 of the combustion gases 34. In this respect, the ejection of the coolant 164 from the outlet apertures 158, 160, 156 may exert a torque on the rotor blade 100, which may supplement the torque exerted on the rotor blade 100 by the combustion gases 34.

Figure 8:
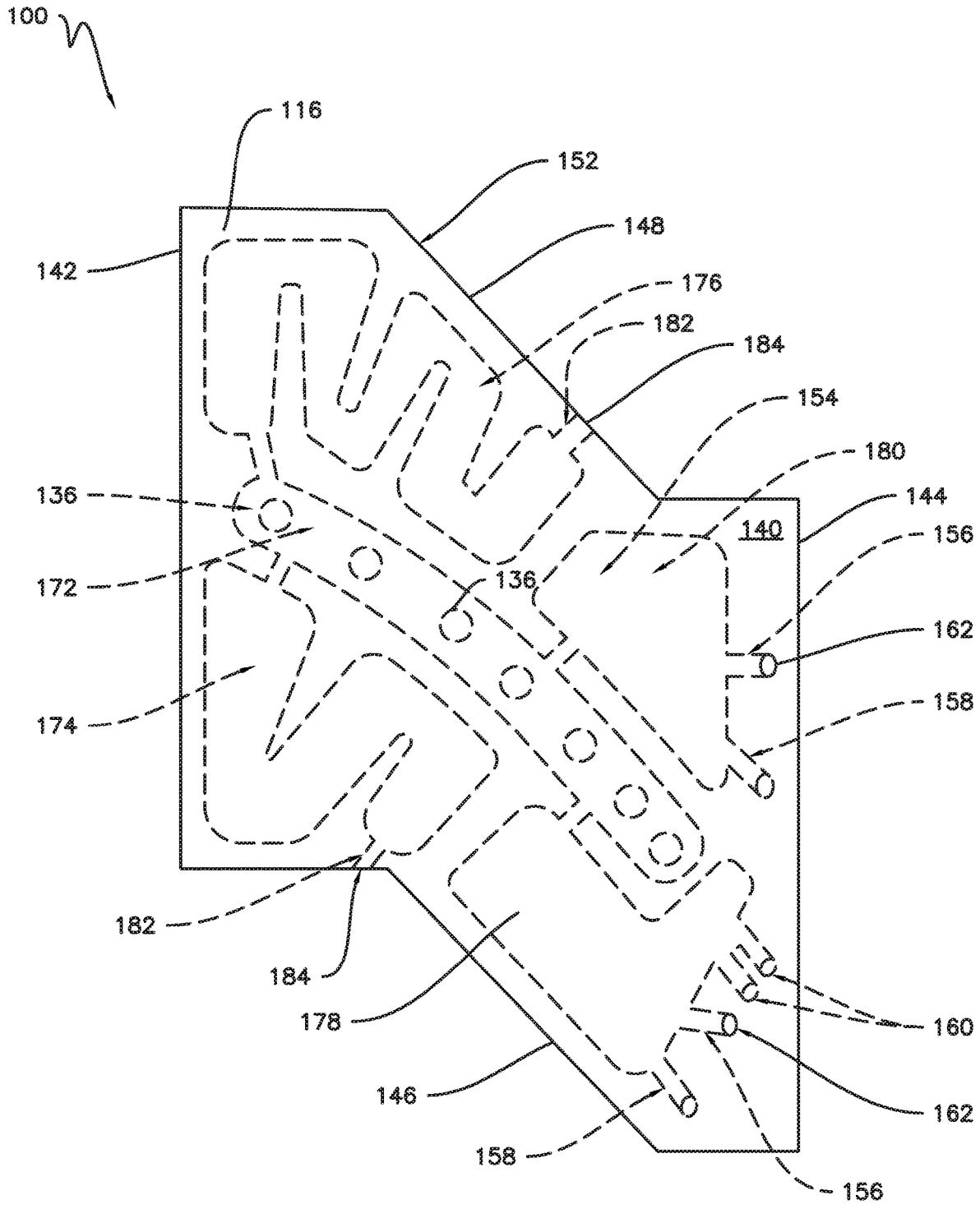
FIG. 8 is a top view of another embodiment of a tip shroud in accordance with embodiments of the present disclosure.

FIG. 8 illustrates an alternate embodiment of the tip shroud 116, which defines the cooling core 154. In the embodiment shown, the cooling core 154 includes various chambers and passages. For example, the cooling core 154 includes a central plenum 172 in fluid communication with the cooling passages 136. The central plenum 172 is, in turn, fluidly coupled to a forward pressure side cavity 174, a forward suction side cavity 176, an aft pressure side cavity 178, and an aft suction side cavity 180. As shown, the forward chambers 174, 176 have a serpentine configuration, and the aft chambers 178, 180 have a non-serpentine configuration. In alternate embodiments, however, the cooling core 154 may have any suitable configuration of chambers and/or passages.

The tip shroud 116 and the airfoil 114 define various outlet apertures through which coolant is ejected or otherwise exhausted from the cooling core 154. In the embodiment shown in FIG. 8, for example, the tip shroud 116 and/or the airfoil 114 define a plurality of first outlet apertures 158, a plurality of second outlet apertures 160, a plurality of third outlet apertures 156, and a plurality of fourth outlet apertures 182. In this embodiment, only a portion of the coolant flowing through the cooling core 154 is ejected from the first, second, and third outlet apertures 158, 160, 156. In alternate embodiments, however, the tip shroud 116 and/or the airfoil 114 may define other outlet apertures in addition to or in lieu of the outlet apertures 158, 160, 156, 182.

The outlet apertures 156, 158, 160, 182 may be fluidly coupled to various portions of the cooling core 154. In the embodiment shown in FIG. 8, for example, one first outlet aperture 158 is fluidly coupled to the aft pressure side cavity 178 and another first outlet aperture 158 is fluidly coupled to the aft suction side cavity 180. Both second outlet apertures 160 are fluidly coupled to the aft pressure side cavity 178. One third outlet aperture 156 is fluidly coupled to the aft pressure side cavity 178 and another third outlet aperture 156 is fluidly coupled to the aft suction side cavity 180. Furthermore, one fourth outlet aperture 182 is fluidly coupled to the forward pressure side cavity 174 and another fourth outlet aperture 182 is fluidly coupled to the forward suction side cavity 176. Although, the first, second, third, and fourth outlet apertures 158, 160, 156, 182 may be fluidly coupled to any suitable portion of the cooling core 154 in alternate embodiments.

As mentioned above, the tip shroud 116 may define one or more fourth outlet apertures 182. More specifically, each fourth outlet aperture 182 may include a fourth opening 184 defined by the exterior surface 152 (e.g., the pressure side or suction side surfaces 146, 148). As such, coolant 164 flows from the forward cavities 174, 176 into the fourth outlet apertures 182 and is ejected from the fourth outlet apertures 182 through the fourth openings 184. Unlike the first, second, and third outlet apertures 158, 160, 156 the fourth outlet apertures 182 may be configured to provide convective cooling to the exterior surface 152.

As discussed in greater detail above, the first and second outlet apertures 158, 160 eject the coolant 164 in the direction of the local flow 166 of the combustion gases 34. In this respect, the first and second outlet apertures 158, 160 create less disturbance of the flow of combustion gases 34 through the hot gas path 32 than conventional outlet aperture configurations. Accordingly, the rotor blade 100 provides better aerodynamic performance than conventional rotor blades.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade for a turbomachine, the rotor blade comprising:

an airfoil including a trailing edge surface, the airfoil defining a cooling passage; and a tip shroud coupled to the airfoil, the tip shroud comprising a radially inner surface, the tip shroud defining a cooling core fluidly coupled to the cooling passage, the cooling core comprising a first outlet aperture having a first opening defined by the trailing edge surface of the airfoil, wherein the first outlet aperture is configured to eject coolant from the cooling core in a direction of a local flow of combustion gases external to the tip shroud.

2. The rotor blade of claim 1, wherein the cooling core further comprises a second outlet aperture having a second opening defined by the radially inner surface, the second outlet aperture configured to eject coolant from the cooling core through the second opening substantially parallel to a camber line at the radially inner surface.

3. The rotor blade of claim 1, wherein the first outlet aperture is configured to eject coolant from the cooling core through the first opening substantially parallel to a camber line at the trailing edge surface of the airfoil.

4. The rotor blade of claim 2, wherein the tip shroud comprises a radially outer surface, the cooling core comprising a third outlet aperture having a third opening defined by the radially outer surface, the third outlet aperture being configured to eject coolant from the cooling core through the third opening substantially parallel to an axial direction extending between a forward surface of the tip shroud and an aft surface of the tip shroud.

5. The rotor blade of claim 4, wherein the first, second, and third outlet apertures are configured to eject a portion of the coolant from the cooling core.

6. The rotor blade of claim 4, wherein the first, second, and third outlet apertures eject all of the coolant from the cooling core.

7. The rotor blade of claim 1, wherein the first outlet aperture is a plurality of first outlet apertures.

8. The rotor blade of claim 2, wherein the second outlet aperture is a plurality of second outlet apertures.

9. The rotor blade of claim 2, wherein the cooling core comprises a forward cavity and an aft cavity positioned downstream of the forward cavity, the aft cavity being in fluid communication with the first and second outlet apertures.

10. The rotor blade of claim 9, wherein the forward cavity comprises a serpentine portion.

11. A turbomachine, comprising:

a turbine section including one or more rotor blades, each rotor blade comprising:

an airfoil including a trailing edge surface, the airfoil defining a cooling passage; and a tip shroud coupled to the airfoil, the tip shroud comprising a radially inner surface, the tip shroud defining a cooling core fluidly coupled to the cooling passage, the cooling core comprising a first outlet aperture having a first opening defined by the trailing edge surface of the airfoil, wherein the first outlet aperture is configured to eject coolant from the cooling core in a direction of a local flow of combustion gases external to the tip shroud.

12. The turbomachine of claim 11, wherein the cooling core further comprises a second outlet aperture having a second opening defined by the radially inner surface, the second outlet aperture is configured to eject coolant from the cooling core through the second opening substantially parallel to a camber line at the radially inner surface.

13. The turbomachine of claim 11, wherein the first outlet aperture is configured to eject coolant from the cooling core through the first opening substantially parallel to a camber line at the trailing edge surface of the airfoil.

14. The turbomachine of claim 12, wherein the tip shroud comprises a radially outer surface, the cooling core comprising a third outlet aperture having a third opening defined by the radially outer surface, the third outlet aperture being configured to eject coolant from the cooling core through the third opening substantially parallel to an axial direction extending between a forward surface of the tip shroud and an aft surface of the tip shroud.

15. The turbomachine of claim 14, wherein the first, second, and third outlet apertures are configured to eject a portion of the coolant from the cooling core.

16. The turbomachine of claim 14, wherein the first, second, and third outlet apertures eject all of the coolant from the cooling core.

17. The turbomachine of claim 11, wherein the first outlet aperture is a plurality of first outlet apertures.

18. The turbomachine of claim 12, wherein the second outlet aperture is a plurality of second outlet apertures.

19. The turbomachine of claim 12, wherein the cooling core comprises a forward cavity and an aft cavity positioned downstream of the forward cavity, the aft cavity being in fluid communication with the first and second outlet apertures.

20. The turbomachine of claim 19, wherein the forward cavity comprises a serpentine portion.

* * * * *